US012768186B2

(12) United States Patent
Ginestet et al.

(10) Patent No.: US 12,768,186 B2
(45) Date of Patent: Oct. 20, 2026

(54) ADAPTIVE EXPERIENCE AND WAVE GENERATION

(71) Applicant: WHITEWATER WEST INDUSTRIES LTD., Richmond (CA)

(72) Inventors: Clement Ginestet, Saint-Ouen-sur-Seine (FR); Axel Terradillos, Vancouver (CA)

(73) Assignee: WHITEWATER WEST INDUSTRIES LTD., Richmond, CA (US)

( * ) Notice: Subject to any disclaimer, the term of this patent is extended or adjusted under 35 U.S.C. 154(b) by 62 days.

(21) Appl. No.: 18/537,663

(22) Filed: Dec. 12, 2023

(65) Prior Publication Data

US 2024/0191527 A1 Jun. 13, 2024

Related U.S. Application Data

(60) Provisional application No. 63/386,957, filed on Dec. 12, 2022.

(51) Int. Cl.
*E04H 4/00* (2006.01)

(52) U.S. Cl.
CPC ..... *E04H 4/0006* (2013.01)

(58) Field of Classification Search
CPC .. A63B 69/0093; A63B 69/125; E04H 4/0006
USPC ..... 4/488, 491
See application file for complete search history.

(56) References Cited

U.S. PATENT DOCUMENTS

| | | | | |
|---|---|---|---|---|
| 11,891,834 | B2 * | 2/2024 | Ginestet | E04H 4/0006 |
| 2002/0056157 | A1 * | 5/2002 | Lochtefeld | E04H 4/0006 4/491 |
| 2005/0148398 | A1 * | 7/2005 | Lochtefeld | A63G 21/18 472/117 |
| 2014/0115770 | A1 * | 5/2014 | McFarland | A63G 31/007 4/491 |
| 2018/0209159 | A1 * | 7/2018 | Perslow | E04H 4/0006 |
| 2019/0304216 | A1 | 10/2019 | Mendelson et al. | |
| 2020/0357211 | A1 | 11/2020 | Mendelson et al. | |

(Continued)

FOREIGN PATENT DOCUMENTS

| | | | |
|---|---|---|---|
| WO | 2017106972 | A1 | 6/2017 |
| WO | 2019100107 | A1 | 5/2019 |

(Continued)

OTHER PUBLICATIONS

International Search Report and Written Opinion for International Application No. PCT/CA2023/051648, mailed Mar. 1, 2024, 14 Pages.

(Continued)

*Primary Examiner* — David P Angwin
*Assistant Examiner* — Illiam R Klotz
(74) *Attorney, Agent, or Firm* — Sterne, Kessler, Goldstein & Fox, P.L.L.C.

(57) ABSTRACT

A system for generating waves in a wave pool in which the number and type of waves generated in a given period and in a given portion of a wave pool can be customized based on the ability, number, and preferences of guests present in a given wave generation session. Guest tracking systems are employed to verify the presence of guests and to allow the system to update the wave generation scenario based on attendance at the session.

20 Claims, 5 Drawing Sheets

(56) References Cited

U.S. PATENT DOCUMENTS

| | | | | |
|---|---|---|---|---|
| 2022/0152517 | A1* | 5/2022 | McFarland | G06F 3/04842 |
| 2022/0349198 | A1* | 11/2022 | Dascomb | E04H 4/0006 |
| 2024/0011312 | A1* | 1/2024 | Wynne-Edwards | F04D 35/00 |
| 2024/0209645 | A1* | 6/2024 | Wynne-Edwards | E04H 4/0006 |

FOREIGN PATENT DOCUMENTS

| | | | |
|---|---|---|---|
| WO | 2022178622 | A1 | 9/2022 |
| WO | 2024124339 | A1 | 6/2024 |

OTHER PUBLICATIONS

Whitewater, "Pool Operations". Endless Surf, Nov. 28, 2022, [online] [retrieved on Jan. 23, 2024]. Retrieved from the Internet: https://web.archive.org/web/20221128071331/https://endlesssurf.com/pool-operations/heading "Half Power", and Figure "Operating Scenarios", 5 pgs.

Wilson T., "Innovations: Endless Surf's Swell Studio & Surf Concierge features", WavePoolMag, Jun. 2, 2021, [online] [retrieved on Jan. 23, 2024]. Retrieved from the Internet: https://web.archive.org/web/20210618143007/https://wavepoolmag.com/endless-surfs-swell-studio-surf-concierge-features/ whole document, 6 pgs.

* cited by examiner

ADAPTIVE EXPERIENCE AND WAVE GENERATION

CROSS REFERENCE TO RELATED APPLICATIONS

This application claims the benefit of U.S. Provisional Patent Application Ser. No. 63/386,957, filed on Dec. 12, 2022, titled "Adaptive Experience and Wave Generation," which is incorporated by reference in its entirety.

BACKGROUND OF THE INVENTION

The present invention relates to the field of wave generation for recreational wave pools. More particularly, it relates to a wave generation system in which the number and type of waves generated in a given period and in a given portion of a wave pool can be customized based on the ability, number, and preferences of guests present in a given wave generation session.

BRIEF SUMMARY OF THE INVENTION

Existing wave pool technology allows for generation of different types of waves in different areas of a pool. For example, a wave generator may create and send large waves to the left half of a wave pool, while sending smaller waves to the right side of the pool. By this method, a wave pool can accommodate surfers of varying skill levels during the same surf session by segregating the surfers according to ability.

Systems and methods for tracking guests in an amusement park are now being used to optimize guest experiences, wait times, and the like. This technology is described, for example, in United States Patent Application Publication Nos. 2019/0304216 A1 and 2020/0357211 A1, both to Mendelson, et al., each of which is incorporated herein by reference. However, the tracking system referenced in this application is not limited to any particular commercial product or system. Aspects of such a tracking system can also be leveraged for use in deep wave pools.

The invention described herein represents an improvement to the wave generation process whereby the number and type of waves generated can be optimized and adapted based on the makeup of the clientele in the pool during a given session. Guest tracking systems can be used to provide information that allows the wave generation system to create an optimal playlist for the guests present.

By monitoring who entered the premises of the wave pool, the system knows how many surfers will surf the session, a figure which may differ from the booking data. Based on this input the system will automatically change the planned wave scenario to adapt the number of waves during the session, the intervals between waves, the number of waves in each set, and the rest time between sets to maximize the surfer experience and minimize the currents in the wave pool and power consumption of the system.

These and other embodiments of the present invention will become apparent to those skilled in the art from a consideration of the following detailed description taken in combination with the accompanying drawings and by the elements, features, and combinations particularly pointed out in the claims. As used throughout, the terms "surfer," "rider," "guest" and "patron" are used interchangeably to refer to the individuals riding waves in the surf facility. The term "operator" refers to the person or entity that operates the surf facility and/or wave pool equipment.

BRIEF DESCRIPTION OF THE DRAWINGS

Exemplary embodiments will be described and explained with additional specifics and details through the use of the accompanying drawings.

DETAILED DESCRIPTION OF THE INVENTION

Figure 1:
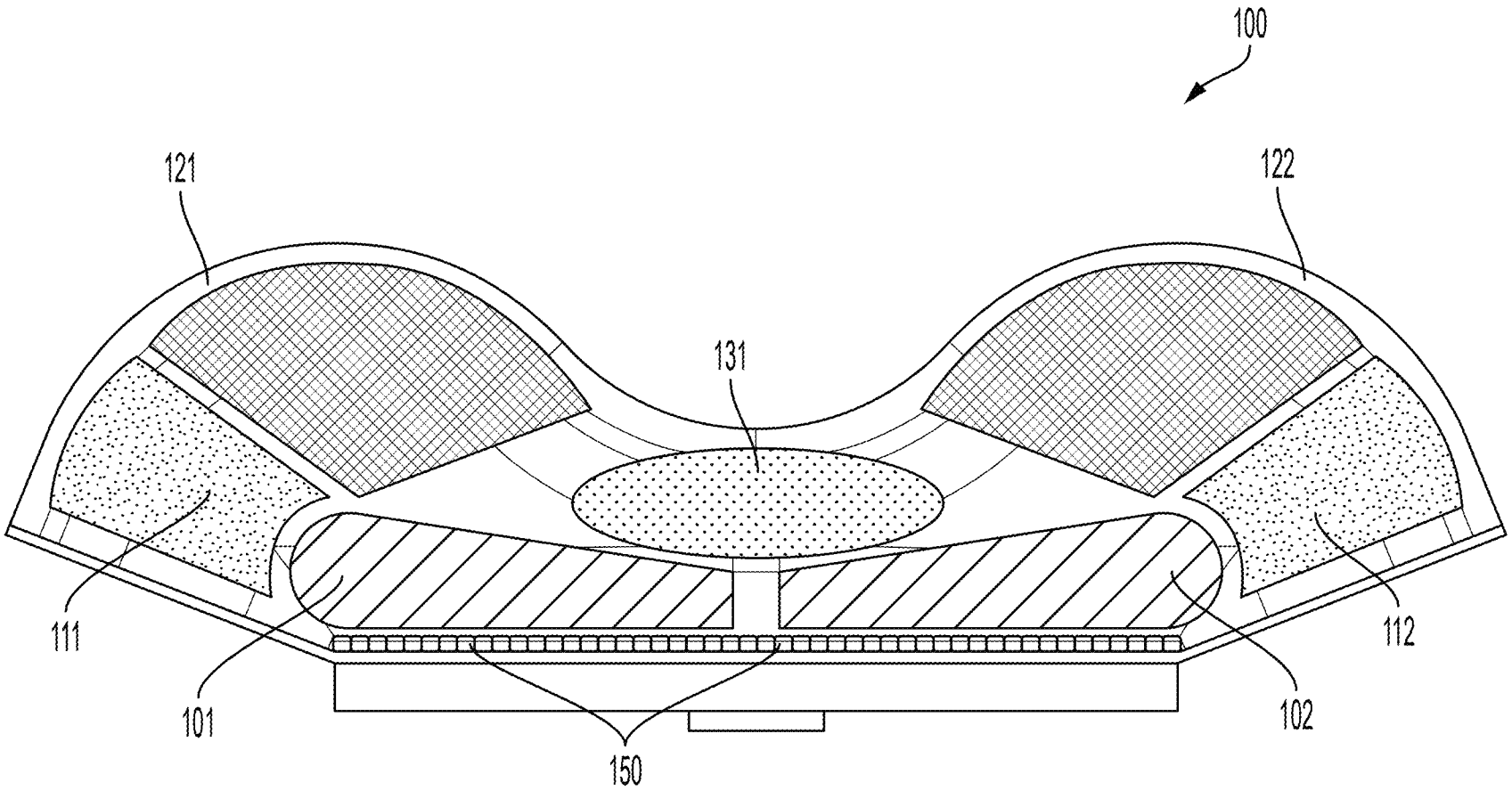
FIG. 1 illustrates one embodiment of a wave pool depicting the various zones of the pool.

Existing wave pool technology allows for generation of different types of waves in different areas of a pool. For example, a wave generator may create and send large waves to the left half of a wave pool, while sending smaller waves to the right side of the pool. While these older technologies have some flexibility in terms of wave per hour, these scenarios need to be predefined by the manufacturer. There is currently no technology that adapts the number of waves in the session depending on the skill level and the number of surfers in the pool. As a result of this combination of predetermined wave sets and fluctuating attendance profiles, many waves (and hence energy) will be wasted.

Another drawback with existing wave technology is that when generating separate left and right waves at the same time (two surfing zones), the number of waves created left and right are usually the same (predefined as well) even if the occupancy is different in the two zones. Again, waves and energy will be wasted in this scenario.

One potential solution is for the operator to manually input the number of waves depending of the occupancy in a given session. However, this can be time consuming and inaccurate, as the operator would have to input each surfer manually.

Another drawback with existing systems and methods is that the interval between waves is fixed by the manufacturer and is not automated to maximize the surfing experience of the patrons and to optimize the power consumption of the system and the currents in the wave pool. If the intervals (i.e., the time between waves) for large waves is too short, it can create a dangerous and stressful situation for the patrons. Again, some waves may be wasted to ensure smooth operations, and will waste energy. Thus one benefit of the current invention is to increase patron enjoyment and safety while also conserving energy.

Existing solutions are not optimal because they do not analyze data on the fly to adapt the system performance. Existing solutions use predefined scenarios to adapt the system performance which is often not relevant to the actual situation in the pool. Existing solutions may also be too complicated due to the high number of possible scenarios when considering number of riders, skill level of the riders, size of the pool, and the like. Existing solutions will need to input the data manually to adapt the system performance which may prove to be too complicated for the operator.

Guest tracking systems can be leveraged for use in deep wave pools to solve certain of these problems. By tracking and monitoring who entered the premises of the wave pool the system knows how many riders actually present who will surf the session, a data point that can differ from the number of surfers who booked a session. Based on this data, the system will automatically change the planned scenario to adapt the number of waves during the session, the intervals between waves, the number of waves in sets and the rest time between sets to maximize the surfer experience and minimize the currents in the wave pool and power consumption of the system, while maintaining the same number of waves offered to each surfer.

The invention described herein represents an improvement to the wave generation process whereby the number and type of waves generated can be optimized and adapted based on the makeup of the clientele in the pool during a given session. Guest tracking systems can be used to provide information that allows the wave generation system to create an optimal playlist for the guests present.

The invention takes advantage of an integration of guest tracking systems that are now well known in the water park industry and systems that provide for customized wave experiences and more readily available feedback for the riders and operators. Examples of such systems include the Swell Studio, Surf Concierge, and Wave Doctor systems created by WhiteWater Industries, Ltd. References in this disclosure to such systems are applicable not just to the commercial embodiments of the WhiteWater systems, but may be adapted to other that provide the appropriate functionality.

As described herein, waves and surf session information (i.e., a series of several waves created in a pool during a period of time) is created via a wave studio application. Once these are created a booking application can pull the library of session from the wave studio application and offer spots in the session to the public. Each sessions includes a prescribed number of slots available for surfers. In one embodiment, a surfer will book a slot in a particular session in advance of the session using an online application, or via kiosk at the wave pool facility.

Once surfers arrive to the premises of the wave pool facility, they will check in to make sure they are at the right session, and to sign waivers, make payment, view safety videos, and the like. In one embodiment, a guest will check in using a guest tracking system that employs a wrist band, RFID device, Bluetooth, or other method to verify that a particular user is actually present at the check-in spot. As used herein, the check-in location may be referred to as a "kiosk." However, the "kiosk" need not have any particular form. By way of example only, the check-in kiosk may be a computer terminal, a scanner, a card swipe device, a Bluetooth reader, or a plate having an RFID reader. By using a physical check-in the guest tracking application can verify and track which patrons have entered the pool and in which zone they will surf. By this method, if there are any guests who had booked a session (e.g., reserved a spot in the session online days or weeks earlier), but did not actually appear at the session on the day, those guests will be removed from the wave session. Once all check-ins are verified and the session is ready to start, the information regarding who entered the pool is sent back to the wave studio application. The wave session will be updated to maximize the wave intervals and wave playlist such that waves are created only for the guests who checked in. In one embodiment, the operator will retain the ability to override the automated playlist to offer additional waves or make any other adjustments that may be necessary based on the conditions of the day.

FIG. 1 depicts an exemplary wave pool 100 according to one embodiment of the current invention. The pool 100 in FIG. 1 generally displays a heart-shaped surfing lagoon, which may have an effect on the location and number of zones. The invention described herein is equally adaptable and applicable to other surf pool shapes. An exemplary division of a wave pool 100 into two main surfing zones located closest to the wave generation chambers 150, with the general area of each zone shown as a left main zone 101 and a right main zone 102. The left main zone 101 and the right zone 102 are capable of being operated independently. Typically, the right-side waves are more popular than the left-side waves.

In the scenario described above, in which fewer guests checked in for a session than had pre-booked that session, the operator is presented with several options to reduce the number of waves compared to the predefined session. A first solution is to extend the interval between waves. For example, instead of having 10 seconds between waves, there will be a 20 second interval before the next wave is generated. Although 10 seconds and 20 seconds are used in this example, a person of skill in the art will recognize that other appropriate intervals may be used. A second solution is to extend the time between sets of waves. For example, the session may comprise 4 sets of ten waves each. After the first set of ten waves, there may be a break of 5 minutes instead of a break of 2 minutes. This allows the surfers more time to regroup and rest before the waves resume. A third solution is to change the number of waves in a set.

Extending the interval between waves will reduce the currents in the pool and will impact the instantaneous peak power. For example, if the interval between waves is originally set to 8 seconds, a set of 10 waves will take 80 seconds. At the end of the 80 seconds, all ten waves have been generated, with an associated total power and associated turbulence created in the pool. However, if the interval is increased to 12 seconds between waves, the set of 10 waves will now take 120 seconds to run their course. Because the waves are not coming as quickly, the water in the pool is afforded more opportunity to settle (reduce turbulence and currents) and the surfers in the pool are given more time to recover between waves. And, although the total power consumed generating the 10 waves may remain the same, but because the waves are spaced apart the total instantaneous power is lowered. Extending the time between sets will reduce the power consumption. The software will adjust these parameters to minimize the currents, which will increase the guest experience (better wave quality, less stressful situation) and minimize the power consumption.

In another example scenario, the system has advance bookings for 40 riders. On the day, only 35 riders actually appear for the session. The total number of riders is known because each rider will check in at the wave pool using the guest tracking system which ties each person at the pool to a guest profile in the booked session. Suppose further that each guest in the session is to have 10 waves in the session. The system now knows that instead of generating 400 waves (10 waves for 40 reservations) in this session, only 350 waves need to be generated (10 waves for 35 actual riders). The system can recalibrate to eliminate 50 waves from the session, saving energy and costs to the operator. The system can then either increase the interval between waves, or the interval between sets, or it may change the number of waves in a set, or any combination of these changes to accommodate for the fewer total number of waves in a session. Alternatively, the system could simply keep the waves on the same schedule, but end the session early as soon as all 350 waves have been generated.

In these scenarios, manual input of the true number of riders may not be feasible or it may be inefficient. Referring again to FIG. 1, the pool may be divided into two groups. Originally, the right side (101) and left side (102) were assigned 20 riders each, for a total of 40 riders in the pool. However, only 35 riders appeared, and the riders may be assigned to 20 riders on the right side, and only 15 riders on the left side. The ride side of the pool does not need to be adjusted at all, but the left side now has fewer riders and fewer waves in the session. By automating the process, the system is able to take the information from each surfer's profile to update and generate a new session based on the total number of riders in the pool. A manual update of the process would be inefficient and may lead to errors. Manual update would also require additional labor costs.

As also shown in FIG. 1, there may be additional surfing areas within a given wave pool. An "inside" zone 111, 112 is located nearer the shore toward the side walls, each of which may be found on both left and right sides of the pool. The inside areas 111, 112 will also have rideable waves, but typically of a different profile than waves in the main surfing zone areas 101, 102. A third area, often called the "shore" area 121, 122 may also have rideable waves. As shown, when waves are generating on both left and right sides of the pools, then both the left and right sides of the pool will typically have main (101, 102), inside (111, 112), and shore (121, 122) areas or zones. The center of the pool is typically calmer and is often used as a waiting zone 131 between sets. A surfer may ride his generated wave in the first set in his chosen zone or zones, then paddle back to the waiting zone 131 where the surfers queue for the start of the next set of waves in a session.

Figure 2:
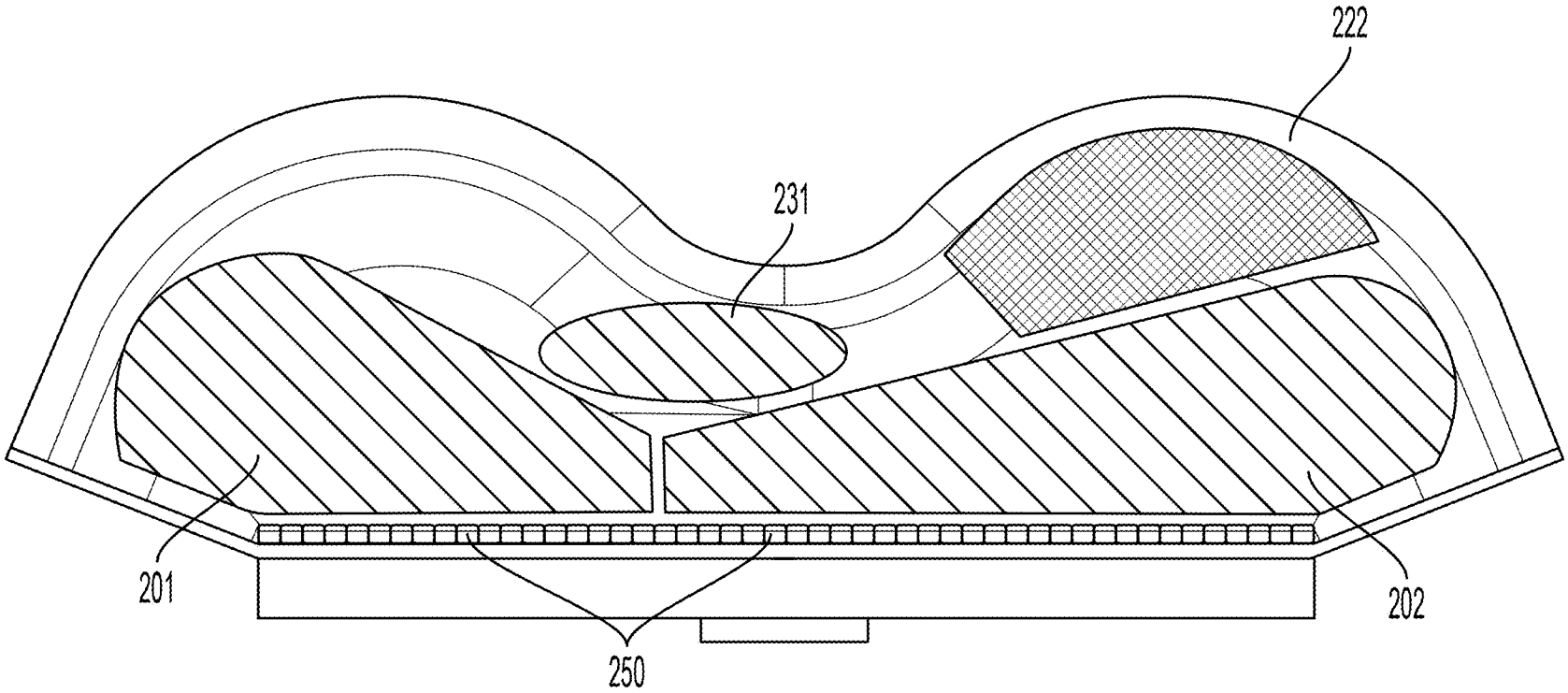
FIG. 2 illustrates another embodiment of a wave pool depicting the various zones of the pool.

It is an object of this invention to allow for the operator to be able to customize the guest experience to create different zones in the wave pool, as may be desired based on the actual patron attendance at the session. FIG. 2 illustrates a second exemplary scenario in a wave pool, wherein waves in the left and right sides of the pool are not symmetrically generated. Waves on the right side of FIG. 2 might be larger and have a greater degree of difficulty, for example. This scenario results in creation of (or elimination) of various different zones that differ from the scenario in FIG. 1. As shown, right main zone 202 near the chamber 250 is larger than the right main zone 102 from FIG. 1. Left zone 201 is also relatively larger. The larger main zones may result in the elimination of the inside zones and the shore zones, as shown in FIG. 2, which features only one shore zone 222 and no inside zones. A waiting zone 231 is still present where there are relatively few waves and the water is relatively calmer.

In another scenario, a session may be booked in a pool similar to that shown in FIG. 1, with a total capacity of 50 surfers on each side of the pool. On the day, the session may be booked for 20 surfers in the main surfing zone left zone (101), 15 in the inside left zone (111), and 15 in the shore left zone (121). By taking advantage of the guest tracking system, the operator can know exactly how many and which types of surfers are present in a session and can generate waves accordingly. The riders simply need to check in at the park and confirm which area of the pool they will be using during a particular session. The system can then generate waves accordingly. The system may also be able to assign riders to a particular zone of the pool based on the surfer's desired wave type. For example, a rider may state that he wishes to surf an intermediate wave on an inside zone. The system may assign that rider to the right inside zone (121), as the left inside zone (111) is reserved for beginners in that particular session.

In another scenario, suppose the system has advance bookings for 5 riders in the main surf zone and 15 riders in the shore surf zone. A main wave generated in the main zone may give at least two surfing opportunities in the shore surf zone. However, if the system generates as many main waves as there are surfers in the main zone, then surfers in the secondary zone will receive a far less satisfactory number of waves. In this scenario, a session that generates five main zone waves will result in only 10 shore zone waves, which is not enough for the number of riders in the shore zone in this scenario. Here, manual input of the true number of surfers may not be feasible or may be inefficient. By automating the process, the system is able to know the number of surfers in main and shore zones and adapt the primary wave generation to create rideable waves for each patron in all zones. For example, in the scenario described here, the system would generate three additional main waves so that each surfer in the shore zone could have at least one ridable wave.

It should be noted that the guest tracking system may include cameras or other sensors that are capable of distinguishing and identifying riders while in the water. One method may be through the use of facial recognition, based on pictures and identifying information associated with the guest profile in the booking application. Another method may be through issuance of identifying arm bands, shirts, wet suits, or life jackets. For example, beginner surfers may be issued an arm band of one color, intermediate surfers an arm band of another color, and advanced surfers an arm band of another color. Each color would be identifiable and distinguishable by the system (using cameras) while the riders are in the water. Alternatively, an arm band, shirt, etc., may have a machine readable code (such as QR code) or text that the system cameras can read. In one embodiment, a pool may be equipped with RFID, Bluetooth, or other electronic sensors capable of detecting a chip or transmitter worn by the rider while in the pool. In this way, the system can verify not just that the rider is present at the pool, but that the rider is present in the expected surf zone during the session.

Figure 3:
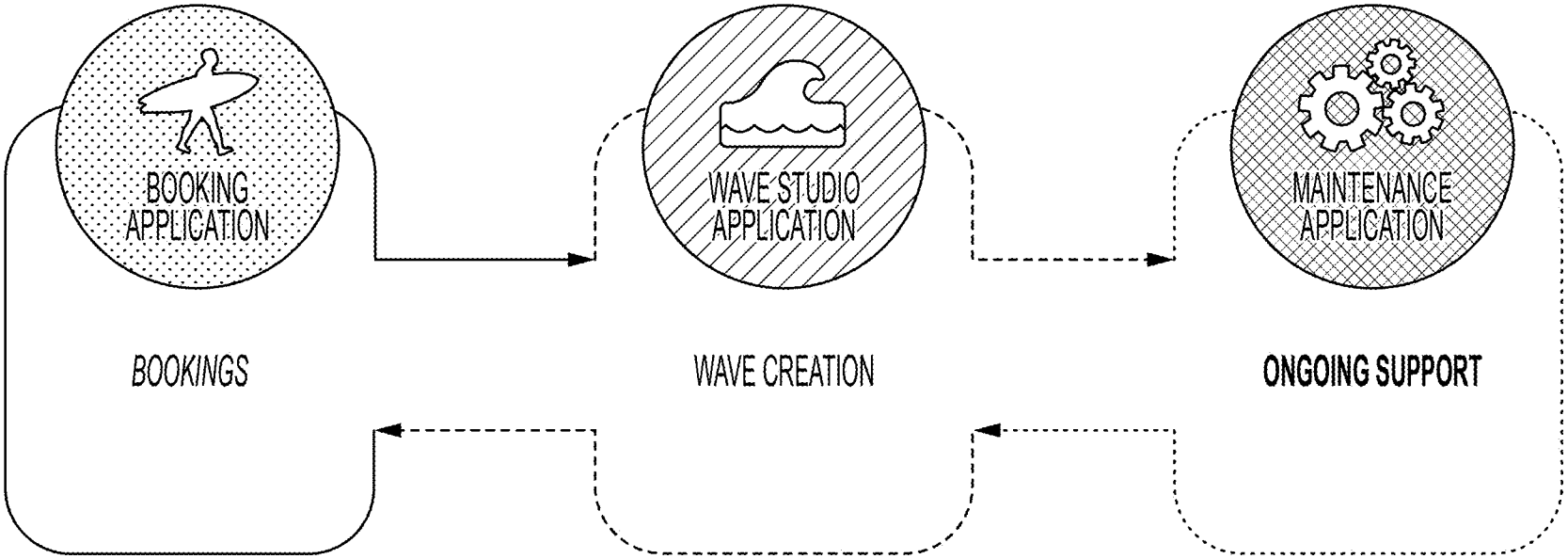
FIG. 3 is a block diagram illustrating exemplary integration between different software in the system described herein.

FIG. 3 illustrates a simple block diagram for the method and system described herein. In the first step, the system creates a session for a given date and time. Guests are then permitted to book a spot in a session using the booking application. Bookings through the booking application may be done online via website or web app, via a station at the wave facility, or via other suitable methods. The guest books a spot using his guest identifier, picking a particular day and time for a session. Typically, the guest will be presented with a list of available sessions so that the guest can book a spot in a session that best fits his or her ability. For example, an advanced surfer would be encouraged to book a session in an advanced session (as opposed to a beginner or intermediate session) so that the surfers in the session will all be surfing similar waves. In the second step, the guest may be presented with the option of choosing a particular wave profile. For example, the guest may be given the option to state his preferences regarding peak wave height, wave length, wave speed, etc., which may be taken into consideration by the system in creating the session. Next, a "playlist" of waves is created by the wave studio application based on the number of guests who have booked a session, the skill level of the guests, and the types of wave that the guests have chosen. When the date and time for the session comes, surfers will check in at the pool using the guest tracking system to confirm that they are physically present for the session. Once the total number of riders actually present is known, the system can finalize the wave playlist as described herein. The information is then sent to the wave studio application which generates the waves during the session. In one embodiment, the riders can also access the booking application after a session to give feedback regarding the session. For example, a rider may indicate that he preferred a particular type of wave from the session, or that he disliked a certain type of wave or quality of a wave. That feedback will be used to generate a playlist for future sessions with that rider.

In one embodiment, a maintenance application is also part of the system. The maintenance application tracks and send metrics relating to total equipment run time, power usage, etc., to a back end of the booking application accessible to the operators.

Preferably, the guests will be grouped and ordered so that similar waves are generated in groups within a set. For example, a given session may include 5 intermediate surfers and 5 advanced surfers. The waves for each type of surfer will typically differ in height, speed, etc. To maximize efficiency for the operator and enjoyment for the surfers, the system will group the 5 intermediate surfers together such that the first 5 waves in a system are intermediate waves; the second 5 waves will be advanced waves for the advanced surfers. This is preferred over a system that alternates back and forth between intermediate and advanced waves within a set. In one example, the first guest to book the session asks for advanced waves, while the next 10 surfers ask for intermediate waves. The system can build a playlist that has the advanced wave up first, followed by 10 intermediate waves, rather than placing the advanced wave in the middle of a session where there is an increased chance that it will be caught by the wrong rider. This provides certainty to the riders as they don't have to closely track how many waves have been generated to know when their particular wave is coming, and it provides advantages in terms of minimizing turbulence and energy usage.

By this method, the turbulence created by the waves may be decreased, and energy efficiency may be increased. This also prevents confusion in the event that an intermediate surfer queues out of order—the intermediate surfer would be assured to still get an intermediate wave because he is riding during the first subset of five waves.

Figure 4:
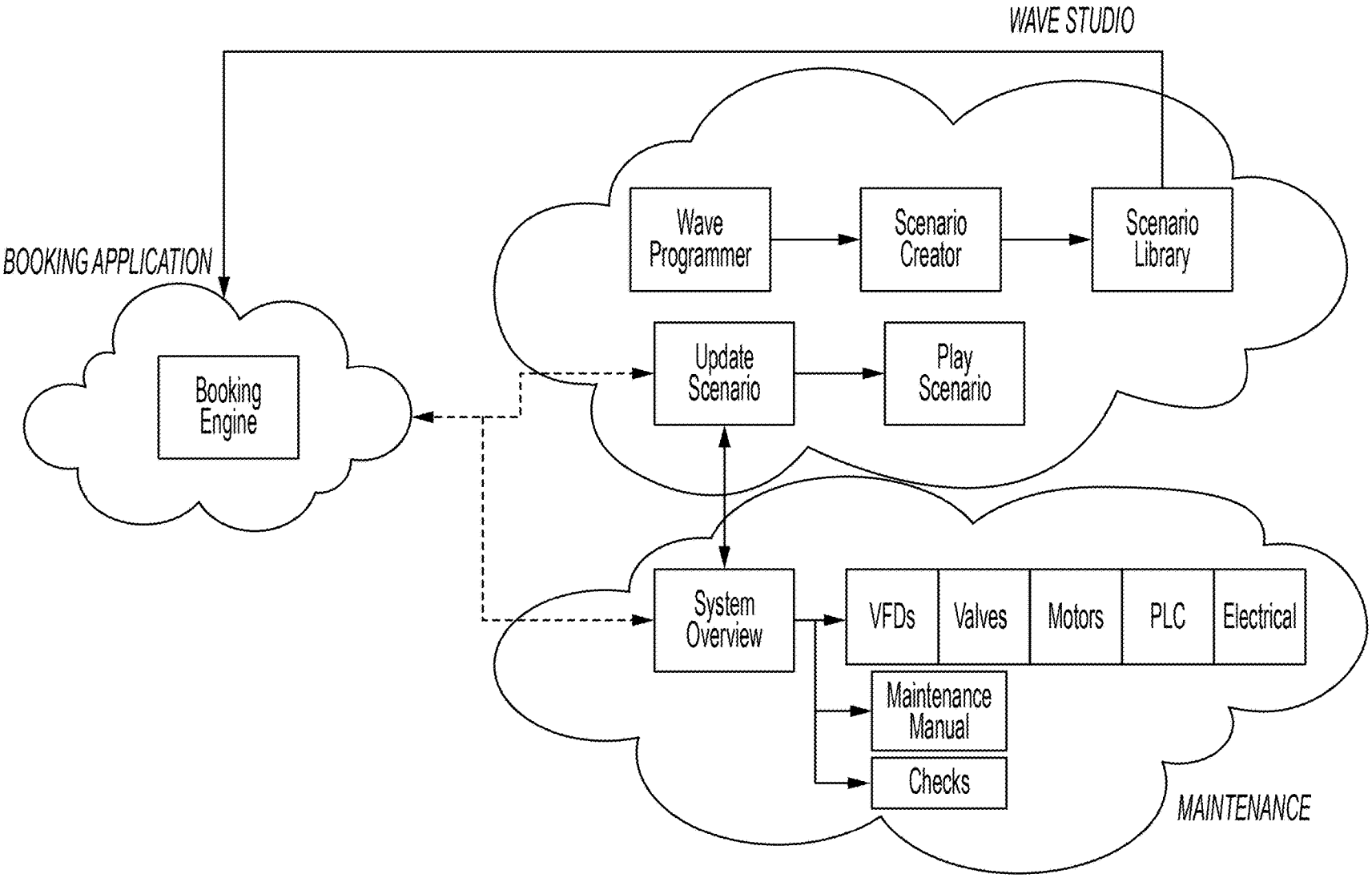
FIG. 4 is a flow chart illustrating various components of an exemplary embodiment of the system described herein.

FIG. 4 shows a diagram illustrating how the booking application, wave studio, and the maintenance application work together to create a surf session. First a scenario is created by the operator and added to a scenario library. The scenario library is linked to the booking application and used to create sessions with slots available for sale via the booking application. A patron logs into the booking application using a guest profile associated with that patron to book a spot in a session that the patron determines is most suitable. At an appropriate time—such as when all slots are filled, or, say a given number of hours before the session begins—the booking application will send the booking informant to the wave studio application to automatically update the scenario based on the demographics of who booked the session. Optionally, the operator may use the wave studio application to manually create or edit the session. Finally, the information is sent back to the booking application and to the maintenance application. When the session begins, the playlist scenario is played and the waves are created in the pool. The maintenance application collects technical data regarding the session, which is then sent back to the booking application, where the data can be accessed by the operator and by the system for use in future sessions.

Figure 5:
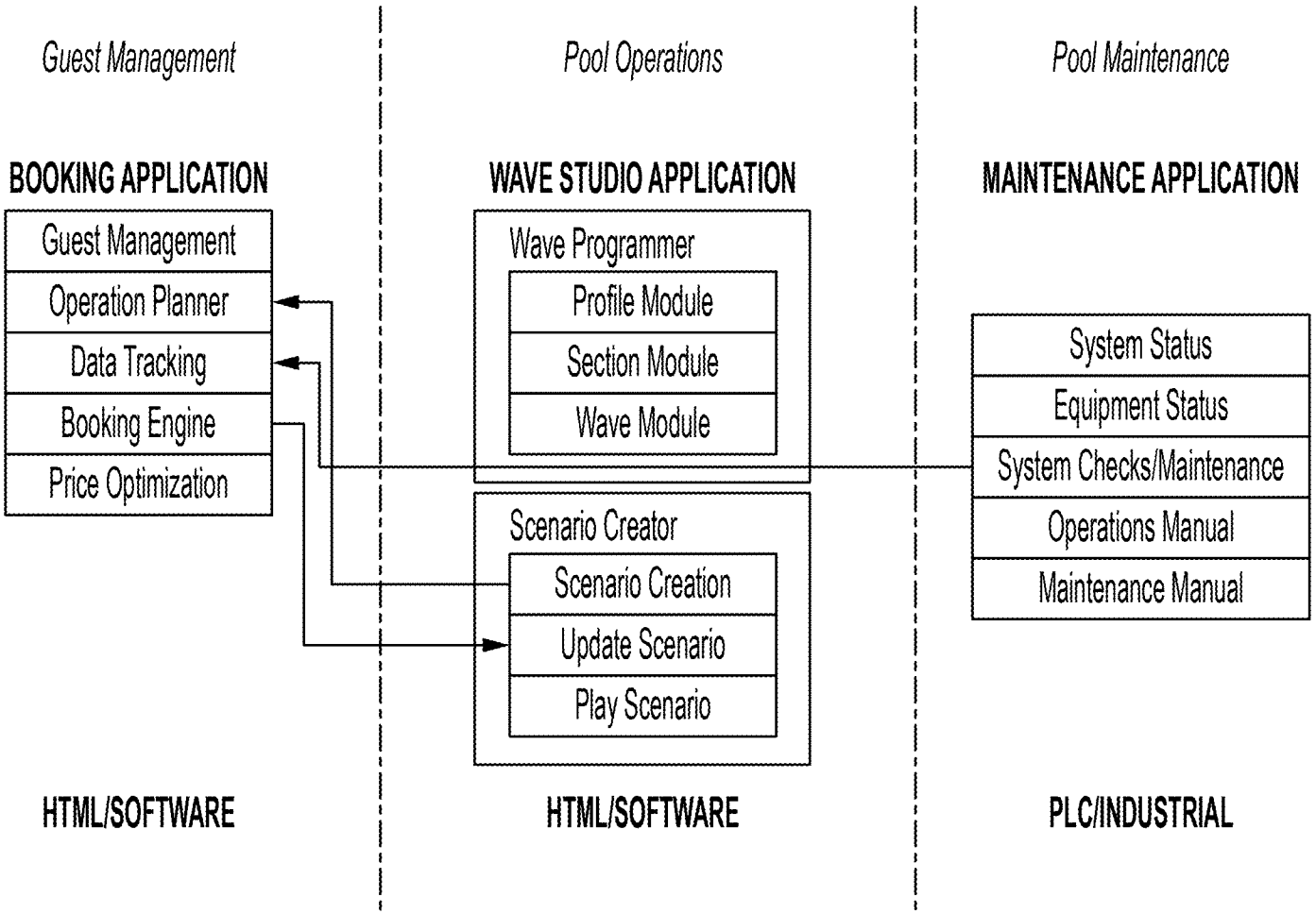
FIG. 5 is a flow chart illustrating various software components of an exemplary embodiment of the system described herein.

FIG. 5 depicts a diagrammatic representation of the software used in a preferred embodiment of the booking application, the wave studio application, and the maintenance application. FIG. 5 further shows how the various applications and modules within each application interact with each other before during, and after a session, as also described with respect to FIG. 4.

While certain embodiments have been provided and described herein, it will be readily apparent to those skilled in the art that such embodiments are provided by way of example only. It should be understood that various alternatives to the embodiments described herein may be employed, and are part of the invention described herein.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

The above descriptions of illustrated embodiments of the system, methods, or devices are not intended to be exhaustive or to be limited to the precise form disclosed. While specific embodiments of, and examples for, the system, methods, or devices are described herein for illustrative purposes, various equivalent modifications are possible within the scope of the system, methods, or devices, as those skilled in the relevant art will recognize. The teachings of the system, methods, or devices provided herein can be applied to other processing systems, methods, or devices, not only for the systems, methods, or devices described.

The elements and acts of the various embodiments described can be combined to provide further embodiments. These and other changes can be made to the system in light of the above detailed description.

In general, in the following claims, the terms used should not be construed to limit the system, methods, or devices to the specific embodiments disclosed in the specification and the claims, but should be construed to include all processing systems that operate under the claims. Accordingly, the system, methods, and devices are not limited by the disclosure, but instead the scope of the system, methods, or devices are to be determined entirely by the claims.

While certain aspects of the system, methods, or devices are presented below in certain claim forms, the inventors contemplate the various aspects of the system, methods, or devices in any number of claim forms. Accordingly, the inventors reserve the right to add additional claims after filing the application to pursue such additional claim forms for other aspects of the system, methods, or devices.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A system for generating waves, comprising:

a database containing profiles for one or more guests, and one or more scenarios for creating a wave in a wave pool;

a controller that creates a surf session for the one or more guests, wherein the surf session comprises a plurality of waves organized into two or more sets of waves;

an interface that allows the one or more guests to book a spot in the surf session, including specifying at least one guest characteristic;

a kiosk that allows the one or more guests to check in at the wave pool before a start of the surf session previously booked by the one or more guests;

wherein the controller updates the surf session to reflect a total number and type of the one or more guests actually present for the surf session, and thereby create a playlist of waves to be created during the surf session, wherein the controller modifies one or more of a time interval between waves in a first set of waves or the time interval between waves in a second set of waves based on the total number and type of the one or more guests that checked in prior to the surf session; and a wave generation system capable of creating the two or more sets of waves based on the playlist generated by the controller, wherein the first set of waves is created in a first zone of the wave pool and the second set of waves is created in a second zone of the wave pool, wherein the first set of waves is different from the second set of waves.

2. The system of claim 1, wherein the controller modifies a time interval between wave sets in the two or more sets of waves based on the total number and type of the one or more guests that checked in prior to the surf session.

3. The system of claim 1, wherein the controller modifies a number of waves in the two or more sets of waves based on the total number and type of the one or more guests that checked in prior to the surf session.

4. The system of claim 1, wherein the controller assigns the one or more guests to particular zones of the wave pool based on a guest's ability and further based on a number and ability of the one or more guests that have checked in to the surf session.

5. The system of claim 1, wherein the at least one guest characteristic is a skill level of the one or more guests.

6. The system of claim 1, wherein the at least one guest characteristic is a preferred wave profile of the one or more guests.

7. The system of claim 1, wherein the at least one guest characteristic is a preferred pool zone of the one or more guests.

8. The system of claim 1, wherein the controller adjusts a number of waves in the first zone of the wave pool, based on the total number and type of one or more guests present in the second zone of the wave pool.

9. The system of claim 1, wherein the first set of waves has a greater degree of difficulty when compared to the second set of waves.

10. A method, comprising:

creating, using a controller, a surf session for one or more guests, wherein the surf session comprises a plurality of waves organized into two or more sets of waves;

booking, using an interface, a spot in the surf session including specifying at least one guest characteristic for the one or more guests;

checking in, using a kiosk, at a wave pool before a start of the surf session previously booked by the one or more guests;

updating, using the controller, the surf session to reflect a total number and type of the one or more guests actually present for the surf session;

creating, using the controller, a playlist of waves to be created during the surf session;

modifying, using the controller, one or more of a time interval between waves in a first set of waves or the time interval between waves in a second set of waves based on the total number and type of the one or more guests that checked in prior to the surf session; and creating, using a wave generation system, the two or more sets of waves based on the playlist generated by the controller, wherein the first set of waves is created in a first zone of the wave pool and the second set of waves is created in a second zone of the wave pool, wherein the first set of waves is different from the second set of waves.

11. The method of claim 10, further comprising:

modifying, using the controller, a time interval between wave sets in the two or more sets of waves based on the total number and type of the one or more guests that checked in prior to the surf session.

12. The method of claim 10, further comprising:

modifying, using the controller, a number of waves in the two or more sets of waves based on the total number and type of the one or more guests that checked in prior to the surf session.

13. The method of claim 10, further comprising:

assigning, using the controller, the one or more guests to particular zones of the wave pool based on a guest's ability and further based on a number and ability of the one or more guests that have checked in to the surf session.

14. The method of claim 10, wherein the at least one guest characteristic is a skill level of the one or more guests.

15. The method of claim 10, wherein the at least one guest characteristic is a preferred wave profile of the one or more guests.

16. The method of claim 10, wherein the at least one guest characteristic is a preferred pool zone of the one or more guests.

17. The method of claim 10, further comprising:

adjusting, using the controller, a number of waves in the first zone of the wave pool, based on the total number and type of the one or more guests present in the second zone of the wave pool.

18. The method of claim 10, wherein the first set of waves has a greater degree of difficulty when compared to the second set of waves.

19. The system of claim 1, wherein the interface allows the one or more guests to provide feedback regarding the surf session to generate a subsequent playlist for a future surf session.

20. The method of claim 10, further comprising:

providing, using the interface, feedback regarding the surf session to generate a subsequent playlist for a future surf session.

* * * * *